United States Patent [19]

Rohr et al.

[11] 4,009,737

[45] Mar. 1, 1977

[54] FILLING THREAD STOP MOTION DEVICE FOR A LOOP

[75] Inventors: Willy Rohr, Hinwil; Viktor Smutny, Wetzikon, both of Switzerland

[73] Assignee: Ruti Machinery Works Ltd., Zurich, Switzerland

[22] Filed: Jan. 28, 1976

[21] Appl. No.: 653,040

[30] Foreign Application Priority Data

Feb. 28, 1975 Switzerland ..... 2551/75

[52] U.S. Cl. ..... 139/370.2; 139/372

[51] Int. Cl.[2] ..... D03D 51/34

[58] Field of Search ..... 130/370.1, 370.2, 371, 130/372, 373, 374, 375, 377

[56] References Cited

UNITED STATES PATENTS

| | | | |
|---|---|---|---|
| 1,482,218 | 1/1924 | Brooks | 139/374 |
| 3,482,608 | 12/1969 | Riha et al. | 139/370.2 |
| 3,570,551 | 3/1971 | Deborde | 139/370.2 |
| 3,602,268 | 8/1971 | Bernath | 139/370.2 |

*Primary Examiner*—Henry S. Jaudon
*Attorney, Agent, or Firm*—Donald D. Denton

[57] ABSTRACT

A filling thread stop motion device for a loom which, upon failure of delivery of a filling thread during the weaving operation, the device shuts down the loom.

10 Claims, 7 Drawing Figures

FILLING THREAD STOP MOTION DEVICE FOR A LOOP

BACKGROUND OF THE INVENTION

The present invention relates to a device for stopping a loom when a filling thread is not introduced during the weaving operation, having a thread sensor arranged on a reed in order to detect the presence or absence of the last filling thread introduced and having a control member or means actuatable by the absence of the filling thread in order to shut down the loom.

In one known filling stop motion device for a loom, the thread sensor is developed as a U-shaped wire which is firmly clamped to the reed and forms a part of an electric circuit for the shutting down of the loom. The other part of this electric circuit comprises a contact member which is firmly mounted on the loom within the path of movement of the U-shaped wire. Upon the beating-up movement of the reed, the U-shaped wire is moved against the contact member. If the last filling thread introduced is present, then it prevents the U-shaped wire from contacting the contact member. If the last filling thread introduced is absent, then the U-shaped wire comes against the contact member whereby the electric circuit is closed and the loom is shut down.

Since the U-shaped wire which is clamped on the upper edge of the reed and extends downward into the plane of the filling thread consists of relatively thin wire and thus is of only slight rigidity there is no assurance that the U-shaped wire will come against the contact member. Furthermore, the dirt which unavoidably collects over a period of time impairs the making of a dependable contact between the U-shaped wire and the contact member. Furthermore, the fact that the U-shaped wire forms the thread sensor and also actuates the contact member constitutes a disadvantage, since this twofold function means that the U-shaped wire cannot be optimally adapted to each of the two functions it must perform in order to reliably sense the absence of a filling thread.

The closest prior art known to the applicants in connection with this application is in U.S. Pat. No. 3,442,301.

SUMMARY OF THE INVENTION

The filling stop motion or means in accordance with this invention avoids these disadvantages and it is characterized by the fact that the thread sensor forms one arm of a biased angle lever which is arranged swingably on the reed and the other arm which, hereinafter referred to as the control arm, is developed as actuating member for the control member. The angle lever is subjected to the biasing force, such as a spring, which swings the thread sensor away from the reed in the direction towards the fell of the cloth so that, upon the beating-up movement of the batten when a filling thread is present, the thread sensor is pressed against the filling thread and is thereby swung back against the reed by the force of the spring as a result of which the control arm is brought into a first position, and upon the absence of a filling thread, the thread sensor remains in its position swung away from the reed until it comes against the fell of the cloth, whereby the control arm is brought into a second position, with the control arm in its second position actuating the control member during the beating-up motion of the reed.

The filling stop motion of the invention thus has the main advantage that the two functions of the filling stop motion, namely on the one hand the detection of the filling thread and on the other hand the giving of a control signal when a filling thread is not present, are clearly separated from each other. On the one hand the thread sensor and the spring acting on the double armed lever can be designed optimally from the detection of the thread, while on the other hand the shape and nature of the control arm as well as the arrangement and nature of the control member can be optimally adapted to each other for the shutting down of the loom.

BRIEF DESCRIPTION OF THE DRAWINGS

The invention will be described below on basis of illustrative embodiments and with reference to the drawings, in which.

DESCRIPTION OF PREFERRED EMBODIMENTS

Figure 1:
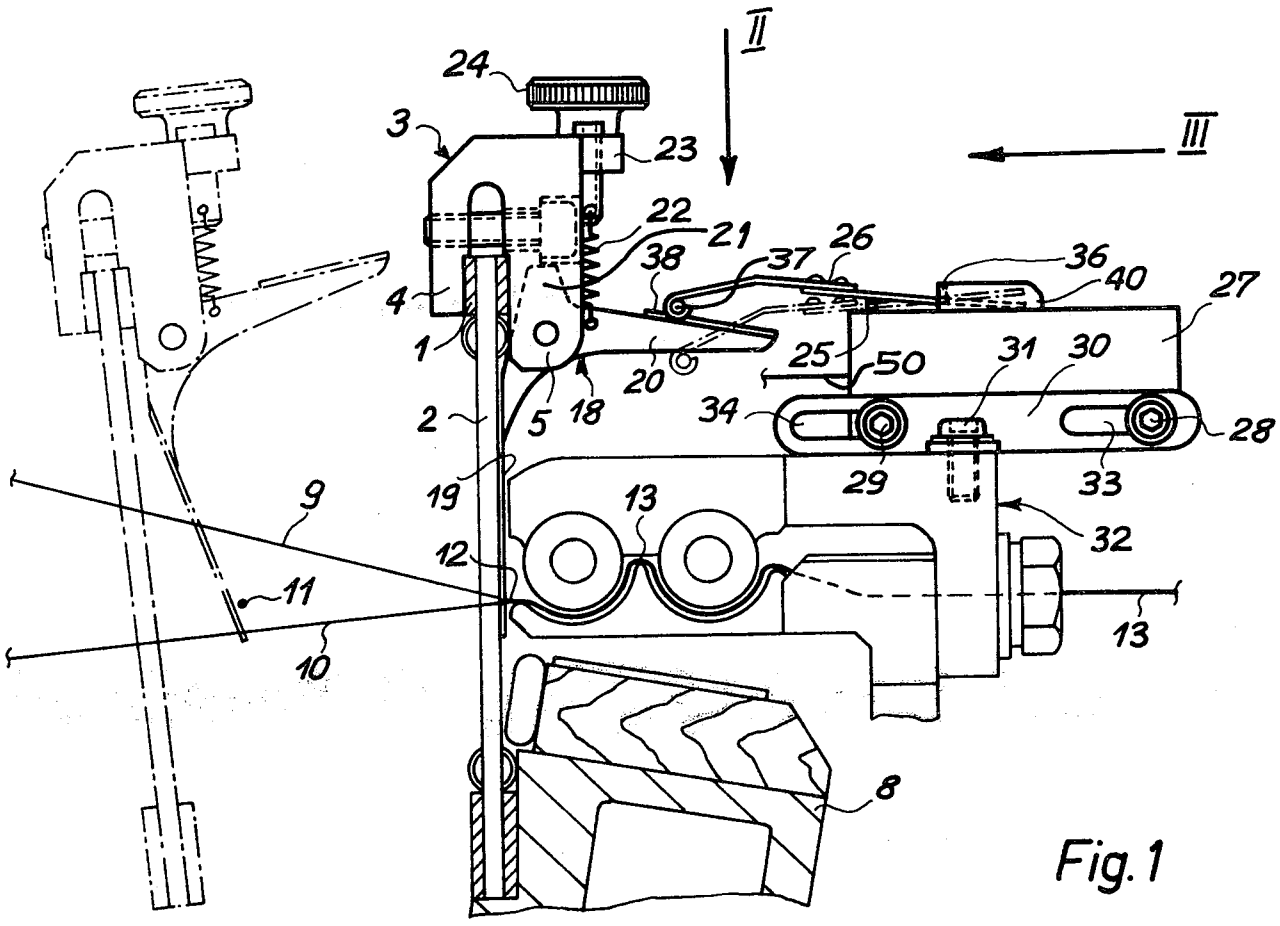
FIG. 1 is a vertical schematic sectional view through the reed of a loom showing a filling stop motion device in accordance with the invention.
Figure 2:
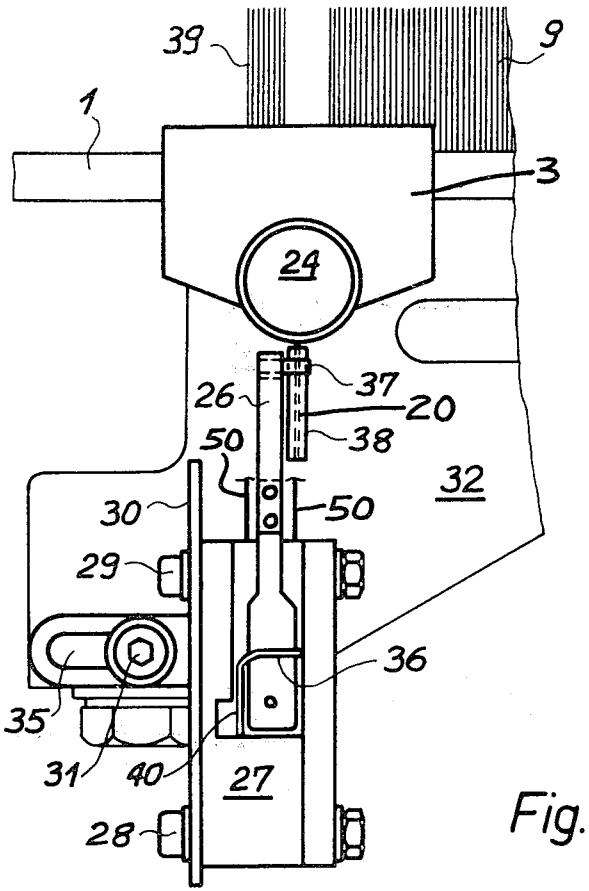
FIG. 2 is a top plan view seen in the direction of the arrow II of FIG. 1.

FIG. 1 shows a side view of the filling stop motion device in cross-section through a reed taken outside the cloth in accordance with the invention. The heavy solid lines show the reed upon the beating-up of the filling thread while the dot-dash showing on the left side of FIG. 1 shows the reed just after the start of its beating-up motion. FIG. 2 is a top view and FIG. 3 is a front view of the filling stop motion device with the temple and the part of the filling stop motion arranged thereon being omitted in FIG. 3 for greater ease in reading the drawing.

Figure 3:
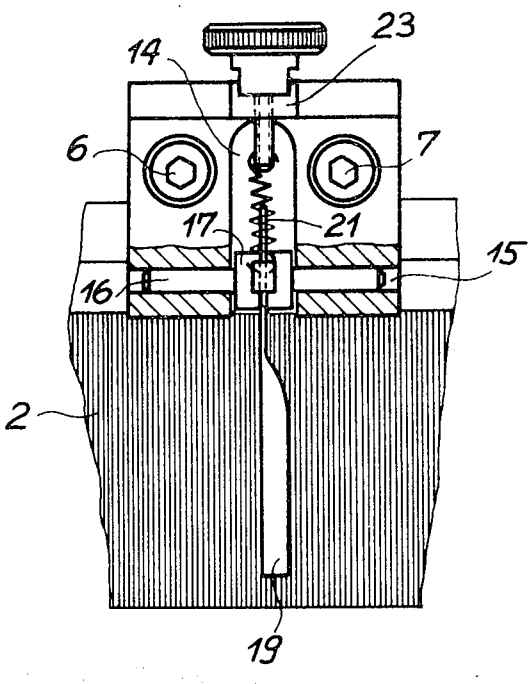
FIG. 3 is an end view seen in the direction of the arrow III of FIG. 1.

As shown in FIGS. 1, 2, and 3, a bearing block 3 is fastened on the upper frame strip 1 of the reed 2 of a loom. The bearing block 3 is substantially U-shaped and placed by means of its inner free space present between the two arms 4 and 5 of bearing block 3 onto the frame strip 1 and clamped fast onto the frame strip 1 by two screws 6 and 7 which pull the two arms 4 and 5 together. The reed 2 is fastened on a batten 8. The batten 8 carries out in operation an oscillating movement by which a filling thread 11 introduced into the shed formed by the warp threads 9 and 10 is beaten by the reed 2 against the fell of the cloth 12. The cloth thus produced is designated 13.

The front arm 5 of the bearing block 3 which faces the fell of the cloth 12 is longer and thicker than the rear arm 4 and is provided at its central portion between the two screws 6 and 7 with a slot-shaped recess 14. The lower part of the arm 5 is provided with a bore hole 15 which extends parallel to the reed 2 and thus in the direction of the filling, a pin 16 being arranged in said bore hole. On the part of the pin 16 which is contained in the recess 14 there is rotatably supported a bearing bushing 17 on which an angle lever 18 is fastened.

The angle lever 18 consists essentially of two arms 19 and 20 making approximately a right angle with respect to each other and it is fastened at its central portion which connects its two arms together onto the bushing 17. The arm 19 which extends downward into the shed has a projection 21 which extends upward beyond the central portion of the angle lever. On the arm 20 of the angle lever 18 there acts the one end of a tension spring 22 whose other end is fastened to a screw 24 which is guided in a projection 23 of the bearing block 3 above the recess 14 and the height of which can be adjusted by rotation.

The arm 19 of the angle lever 18 serves as thread sensor for the detection of the presence or absence of the filling thread last introduced, while the arm 20 serves as actuating element for a control member for shutting down the loom when the last filling thread introduced is not present, said control member comprising a push button switch 25 for closing an electric circuit 50 and a switch lever 26 associated with the push button switch. The extension 21 of the arm 19 serves as stop to limit the swinging motion of the angle lever 18 under the action of the tension spring 22. The angle lever 18 may be punched out of relatively thin metal plate. In order to increase the rigidity of the thread sensor of the arm 19, it is turned 90° with respect to the rest of the angle lever directly in the part thereof adjoining the central portion of the angle lever. The sensor or arm 19 is thus relatively broad and cannot jam between the teeth of the reed 2. A small guide plate 38 is soldered onto the upper edge of the angle lever arm 20 so that the arm 20 has a T-shaped profile in this region.

The push button switch 25 and the switch lever 26 are mounted on a prism shaped support body 27. The support body 27 is fastened by two screw connections 28 and 29 to an L-shaped support rail 30 which in its turn is mounted by a screw 31 on a stationary part of the loom, for instance, as shown in the drawing, on the temple 32. The temple 32 is known and will not be further described here. The screws 28, 29, and 31 are guided in slots 33, 34, and 35, respectively, in the support rail 30, the longitudinal direction of the slots 33 and 34 being in the direction of the warp and the longitudinal direction of the slot 35 being in the direction of the filling. Due to the slots 33 and 34 the support body 27 can be displaced in the direction of the warp and due to the slot 35 the support rail 30 together with the support body 27 can be displaced in the direction of the filling, and adjusted by means of the screws 28, 29, and 31.

The push button switch 25 has the shape of a pin and extends through the force of a spring (not shown) out of the cover surface of the support body 27. In order to actuate the shut-off mechanism of the loom, the switch 25 must be pushed down. The switch lever 26 is of elongated shape and consists of two strips of metal plate riveted to each other. The metal strip further away from the reed 2 lies on the switch 25 and is held from above by a rail 36 approximately in its center between its free end and the push button switch 25 and pressed against the support body 27.

Figure 6:
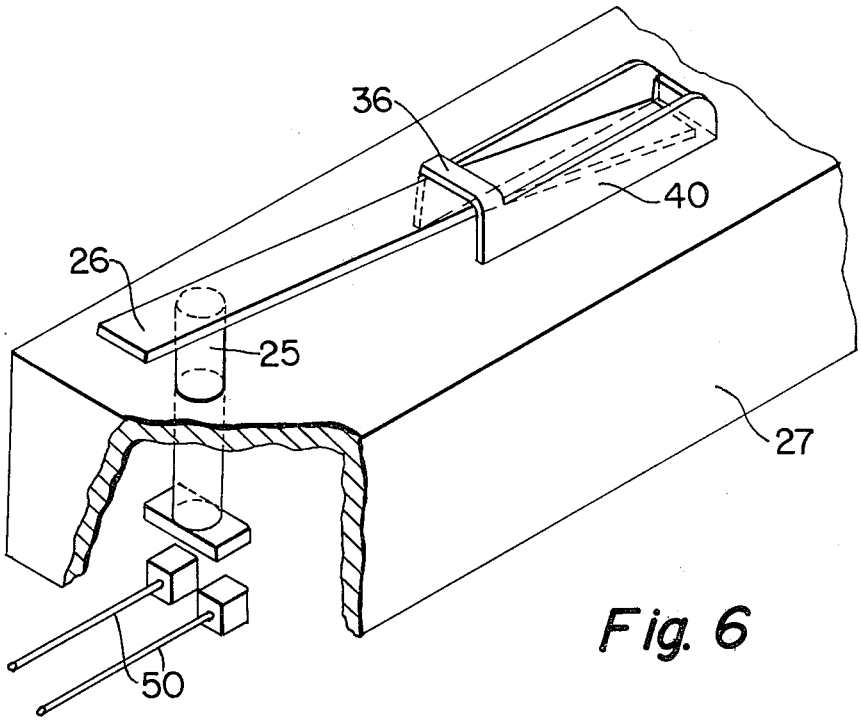
FIG. 6 is a perspective view in elevation showing details of the switch and its switch lever of FIG. 1.
Figure 7:
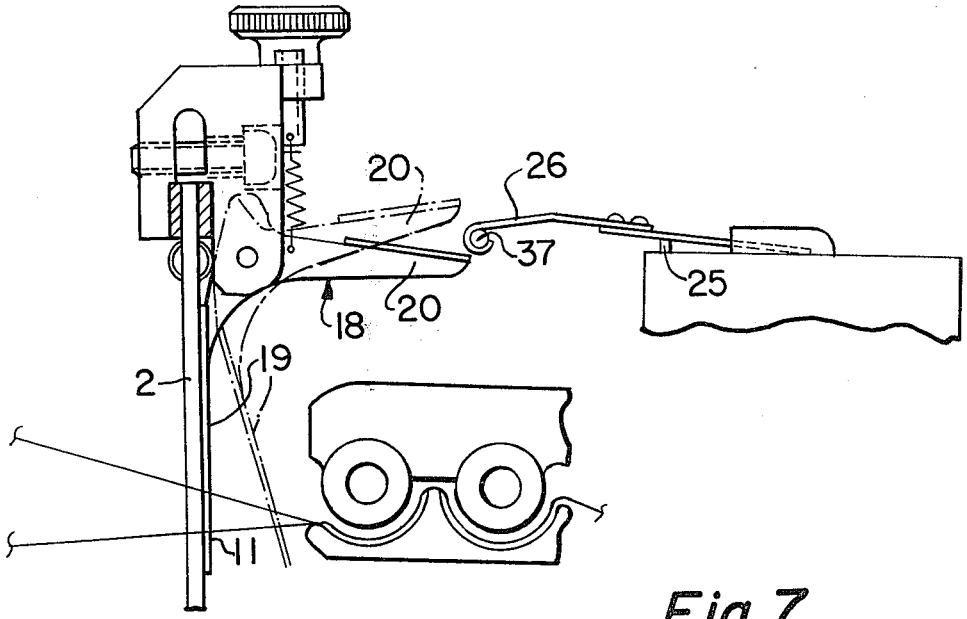
FIG. 7 is a partial view in elevation showing the position of the switch lever of FIG. 1 during the beat-up motion.

FIG. 6 shows the mounting of switch 25 and switch lever 26 on the prism shaped support body 27. When switch 25 is pushed down, and electric circuit 50 is closed and the loom will be stopped. Also shown is plate 40 and rail 36 which consists of a single piece, the rail 36 forming an extension of plate 40 and being bent at right angles to the plate 40.

The rail 36 is mounted on a small metal plate 40 connected with the support body 27. As shown in the drawing (FIG. 2), the plate 40 and the rail 36 consist of a single piece and the rail 36 which forms an extension of the plate 40 is bent at right angles to the plate 40. The metal strip of the switch lever 26 which faces the reed 2 is bent slightly downward at its center towards the cloth 13 and is flanged at its free end around a pin 37 which protrudes parallel to the direction of the filling on one side of the sheet metal strip.

The support body 27 with the push button switch 25 and the switch lever 26 is fastened in such a manner on the temple 32 with respect to the angle lever 18 that the free end of the pin 37 extends into the plane of movement of the arm 20 of the angle lever 18 upon the oscillating movement of the angle lever which takes place together with the reed 2. Length, shape and position of the switch lever 26 are so adapted to the arm 20 of the angle lever that on the one hand when filling thread 11 is present by which the arm 20 is swung downward against the force of the spring 22 upon the beating-up movement of the reed already at a relatively early time (FIG. 1, dot-dash showing), the upper edge of said arm or the guide plate 38 moves below the pin 37 as a result of which the switch lever 26 remains in its position of rest and the switch 25 is not actuated. On the other hand, when no filling thread 11 is present, the arm 20 remains in its swung position effected by the spring 22 over a relatively long portion of the beating-up movement of the reed 2, its lower edge extending over the pin 37. When the thread sensing element 19 comes against the fell of the cloth 12, the arm 20 is swung downward and the switch 25 is actuated (FIG. 1, dot-dash position of the switch lever 26).

The filling stop motion shown in FIGS. 1 through 3 can be used wherever the filling thread is withdrawn from a large supply arranged outside the loom. The bearing block 3 with the angle lever 18 is mounted at such a place of the reed that the thread sensor 19 comes to lie along one of the side edges of the cloth outside the cloth. It has been found to be particularly advantageous for the filling stop motion to be arranged on the exit side of the filling thread. When the side edge of the cloth is formed with the production of a so-called auxiliary edge or lost edge, the filling stop motion is so positioned that, as in the case of FIG. 2 in which the warp threads serving for the formation of the cloth are designated 9 and the filling threads intended for the formation of the auxiliary edge are designated 39, the thread sensor element lies in the free space between the side edge of the cloth and the auxiliary edge. Since the filling threads do not have any very great mechanical strength in this region, if the filling thread is absent the thread sensor 19 will, upon the beating-up, push the filling threads which have already been woven into the cloth, somewhat against the temple 32 and thereupon run-on against the temple. Since the temple 32 thus forms a stop for the thread sensor 19, assurance is had that the thread sensor is positively swung against the reed 2 and that the switch lever 26 is definitely pressed against the switch 25.

Of course, the connection between the arm 20 of the angle lever 18 and the shut-off mechanism of the loom need not necessarily take place via the switch lever 26 and the switch 25. Since the thread sensor 19, depending on whether the filling thread 11 last introduced is present or not, is swung against the reed already at a relatively early or only at a relatively late time during the beating up movement of the batten 2, any other desired means for detecting the swinging motion of the arm 20 of the angle lever 18 can be used. Thus it would be possible for instance to check on the swinging movement of the arm 20 by a light barrier or other sensing means which controls the shutting-off device of the loom.

Figure 4:
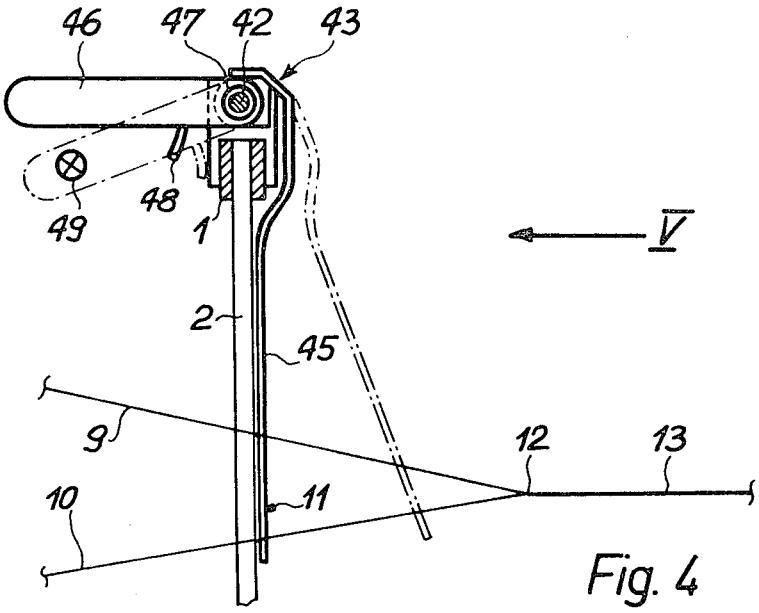
FIG. 4 is a modified arrangement of the filling stop motion device shown in FIG. 1.
Figure 5:
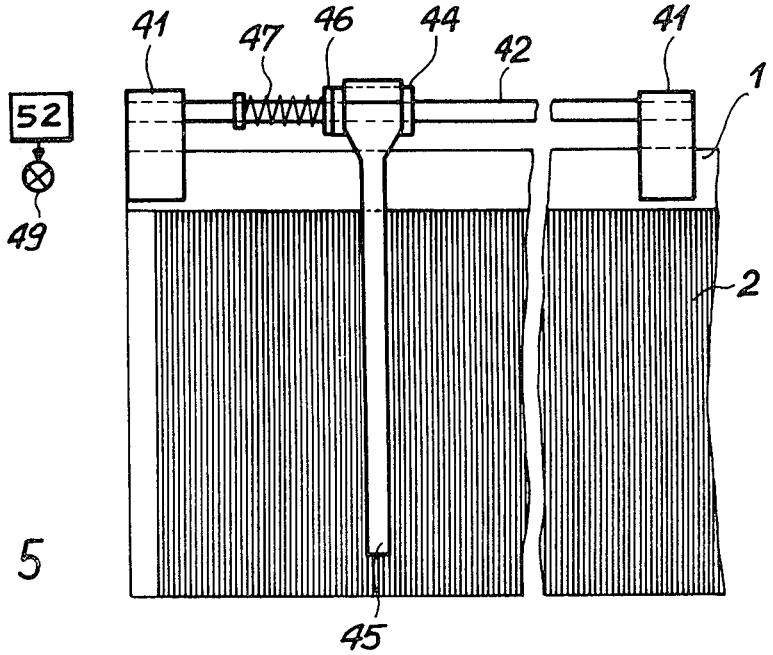
FIG. 5 is a vertical schematic sectional view as seen in the direction of the arrow V of FIG. 4.

FIGS. 4 and 5 show a variant of the filling stop motion of FIGS. 1 to 3, in which the actuating of the shut-off mechanism of the loom is effected photoelectrically.

Referring to FIGS. 4 and 5, two bearing blocks 41 in which a shaft 42 is supported are fastened in the region of the one end of the upper frame strip 1 of the reed 2. An angle lever 43 is swingably mounted on the shaft 42. The angle lever 43 consists of a prism-shaped central portion 44 in which the mounting on the shaft 42 takes place, of a strip-shaped thread sensor 45 which is fastened to the central portion 44, extended around the upper frame strip 1 of the reed 2, and protrudes downward into the shed, and of an arm 46 which is also fastened to the central portion 44. The angle lever 43, which is adjustable as desired in the direction of the filling on the shaft 42 in order to adapt to the width of cloth, is subjected to the force of a torsion spring 47 which moves the thread sensor 45 away from the reed.

The arm 46 which extends to the rear of the reed 2 and is perpendicular to the thread sensor 45 bears at its lower edge a stop pin 48 which limits the amount of swing of the thread sensor 45. The thread sensor 45 and the arm 46 form an approximately right angle with each other.

When the filling thread 11 last introduced is present, the thread sensor 45, upon the beating-up movement of the reed 2, is swung at a relatively early time against the filling thread and swung back by the latter against the force of the spring 47 against the reed 2 (FIG. 4, solid line position). If the filling thread 11 on the other hand is absent, then the thread sensor 45 remains in its position swung away from the reed 2 until impingement on the fell of the cloth 12 (FIG. 4, dot-dash position). Shortly before the thread sensor 45 comes against the fell 12 of the cloth, the arm 46 therefore assumes one of two well defined positions, depending upon whether the filling thread 11 is present or not. By suitably arranging on the frame of the loom a photo detector means 49 of known construction of a photo-electric system 52, which consists of a source of light and a photosensitive element and an emission beam which is reflected by the arm 46 onto a receiver in the swung position which position corresponds to the absence of the filling thread 11 and is not reflected in the other swung position. The information given by the thread sensor 45 as to the presence or absence of the filling thread 11 is thus evaluated. The arm 46 is provided for this purpose with a reflective surface on the side thereof facing the detector means 49. The photo detector means 49 is so arranged that the beam of light emitted by it is intercepted by the arm 46 only when the latter assumes its swung position corresponding to the absence of the filling thread 11. As soon as the receiver of the photo detector means is struck by the light reflected by the arm 46, the absence of the filling thread 11 last introduced is noted and the loom is shut off.

The two filling stop motion means described above have proven to be extremely reliable in actual practice. They are furthermore of universal use and can be rapidly and in simple manner adapted to different widths of cloth. Another advantage of the filling stop motion means described above is their extremely low cost of manufacture.

Practical use has also shown that the filling stop motion means described can be employed also on conventional looms. In this case a filling stop motion means is advantageously arranged on both sides of the cloth and by suitable switch means it is seen to it that in each case the information of the filling stop motion device on the entrance side of the filling thread is suppressed and the information of the filling stop motion device on the exit side of the filling thread is taken into consideration.

It will be appreciated that various changes and/or modifications may be made within the skill of the art without departing from the spirit and scope of the invention illustrated, described, and claimed herein.

What is claimed is:

1. A filling thread stop-motion device for a loom comprising a reed, a weft thread sensor for detecting the presence or absence of the last introduced weft thread and a control means for stopping the loom upon sensing the absence of the last introduced weft thread by said weft thread sensor, characterized by the fact that a. the weft thread sensor is formed from one arm of an angle lever swingably arranged on the reed with the other arm of the angle lever forming a control arm for actuating said control means, said angle lever being subjected to a biasing means, said biasing means swinging the weft thread sensor away from the reed towards the fell of the cloth and locating the control arm in a first position;

b. the control means comprises a push button switch and a switch lever operatively associated with it;

c. in the presence of the last introduced weft thread the weft thread sensor upon the beating-up motion of the reed is pressed against said weft thread and thereby swung back towards the reed, whereby the control means is brought into a second position before contacting the switch lever; and d. in the absence of the last introduced weft thread the weft thread sensor remains in the position swung away from the reed until the end of the beating-up motion of the reed, whereby the control arm is brought from the first into the second position and thereby actuates the switch lever of the control means when the weft thread sensor strikes against the fell of the cloth.

2. The filling thread stop motion device of claim 1 in which the angle lever is supported on an upper edge strip of the reed and the thread sensor extends laterally of the warp threads through the region defined by an imaginary extension of the shed.

3. The filling thread stop motion device of claim 2 in which each arm of the angle lever is made from thin metal material and the plane of the thread sensor is parallel to the direction of the filling while the plane of the control arm is perpendicular to the direction of the filling.

4. The filling thread stop motion device of claim 3 in which the two arms of the angle lever form an at least approximate right angle with respect to each other and the control arm extends from the reed in the direction towards the fell of the cloth.

5. The filling thread stop motion device of claim 4 in which the angle lever is made of a single piece of sheet metal and is supported in its central portion on a bearing block which is fastened to the upper edge strip of the reed, and the thread sensor is turned around its longitudinal axis with respect to the control arm and the middle portion of the angle lever.

6. The filling thread stop motion device of claim 5 in which the bearing block is positionable along the upper edge strip of the reed.

7. The filling thread stop motion device of claim 6 in looms in which the formation of the side edge of the cloth is effected by means of a so-called auxiliary edge, in which the bearing block is then fastened at such a place of the upper edge strip of the reed that the thread sensor extends into the free space between the warp threads for the cloth and the warp threads for the auxiliary edge.

8. The filling thread stop motion device of claim 1 in which the push button switch and its associated switch lever are supported in a common bearing body, the push button switch extending out of the bearing body and the switch lever being held between the push button switch and the point of rest of its one end on the bearing body on its one side and a rail strip on its other side operatively connected to the bearing body.

9. The filling thread stop motion device of claim 8 in which the switch lever defines an elongated strip-like shape at one end and is flanged at its free other end around a pin which extends into the plane of movement of the control arm of the angle lever upon the beating-up motion of the reed, and the position and orientation of the switch lever is so selected relative to the angle lever that the control arm in its second position when contacting the switch lever has its upper edge moving below the pin, whereby the switch lever is secured against being swung towards the push button switch, while in its first position when contacting the switch lever its lower edge travels onto the pin whereby the switch lever is pressed downward and the push button switch actuated.

10. The filling thread stop motion device of claim 8 in which the bearing body is detachably mounted and adjustable in warp and filling directions on a stationary part of the loom on the side of the emergence of the filling thread out of the shed.

* * * * *